US007200872B2

(12) United States Patent
Gregory

(10) Patent No.: US 7,200,872 B2
(45) Date of Patent: Apr. 10, 2007

(54) ARTICLE OF THERMAL CLOTHING FOR COVERING THE UNDERLYING AREA AT THE GAP BETWEEN A COAT SLEEVE AND A GLOVE

(76) Inventor: Kathryn Gregory, 31 Meadowbrook Rd., Bedford, MA (US) 01730

( * ) Notice: Subject to any disclaimer, the term of this patent is extended or adjusted under 35 U.S.C. 154(b) by 196 days.

(21) Appl. No.: 10/720,495

(22) Filed: Nov. 24, 2003

(65) Prior Publication Data

US 2004/0154070 A1 Aug. 12, 2004

Related U.S. Application Data

(63) Continuation-in-part of application No. 10/196,352, filed on Jul. 16, 2002, now abandoned, which is a continuation of application No. 09/243,274, filed on Feb. 2, 1999, now Pat. No. 6,418,561, which is a continuation-in-part of application No. 08/669,653, filed on Jun. 24, 1996, now Pat. No. 5,864,886, which is a continuation-in-part of application No. 08/318, 142, filed on Oct. 5, 1994, now abandoned.

(51) Int. Cl.
*A41D 19/00* (2006.01)

(52) U.S. Cl. ..... 2/170; 2/162

(58) Field of Classification Search ..... 2/16, 2/162, 59, 160; 602/14; 128/878, 879; 607/108, 607/111

See application file for complete search history.

(56) References Cited

U.S. PATENT DOCUMENTS 1,179,871 A 4/1916 St. John
1,374,257 A 4/1921 Van Raalte
1,524,137 A 1/1925 Kastl et al.
2,558,533 A 6/1951 Bell
2,686,913 A 8/1954 Brierley
2,705,327 A 4/1955 Gitt
2,778,027 A 1/1957 Bacon (Continued)

FOREIGN PATENT DOCUMENTS

CH 680036 6/1992

(Continued)

OTHER PUBLICATIONS

U.S. Calvary, World's Finest Military and Adventure Equipment, Spring Catalog, 1992, p. 41, Item K.

*Primary Examiner*—Katherine Moran
(74) *Attorney, Agent, or Firm*—Pandiscio & Pandiscio

(57) ABSTRACT

An article of thermal clothing for covering an underlying area at a gap between a coat sleeve and a glove. The article of clothing includes a tube having a distal portion terminating in a distal end, a proximal portion terminating in a proximal end, and a side opening formed in the distal portion adjacent to but spaced from the distal end. The tube is sized to snugly fit over a wearer's hand and forearm so that the distal end of the tube is positioned near a midpalm area of the hand. The proximal end of the tube is positioned at the forearm area, and the wearer's thumb extends out through the tube's side opening. The tube is formed out of a flexible, stretchable material providing good thermal insulation. A pocket is fixed to the tube and is adapted to receive and retain a warming device.

19 Claims, 7 Drawing Sheets

U.S. PATENT DOCUMENTS

| | | | | | |
|---|---|---|---|---|---|
| 2,904,792 | A | | 9/1959 | Elliott | |
| 3,117,786 | A | | 1/1964 | Anderson | |
| 3,416,518 | A | * | 12/1968 | Samuels et al. | 602/3 |
| 3,657,741 | A | | 4/1972 | Blanco | |
| 3,837,007 | A | * | 9/1974 | Girest | 359/519 |
| 4,011,596 | A | | 3/1977 | Chang | |
| 4,034,979 | A | | 7/1977 | Wester | |
| 4,531,241 | A | * | 7/1985 | Berger | 2/161.2 |
| 4,815,146 | A | | 3/1989 | Theewis et al. | |
| 4,856,112 | A | | 8/1989 | Effle | |
| 4,961,418 | A | | 10/1990 | McLaurin-Smith | |
| 4,967,419 | A | | 11/1990 | Elliott | |
| 5,388,271 | A | | 2/1995 | Sessoms | |
| 5,402,536 | A | | 4/1995 | Matthews | |
| 5,415,624 | A | * | 5/1995 | Williams | 602/21 |
| 5,511,248 | A | | 4/1996 | Widdemer | |
| 5,542,121 | A | | 8/1996 | Lahaussois et al. | |
| 5,551,087 | A | | 9/1996 | Blutstein et al. | |
| 5,603,122 | A | | 2/1997 | Kania | |
| 5,822,800 | A | | 10/1998 | Anderson | |
| 5,864,886 | A | | 2/1999 | Gregory et al. | |
| 5,878,435 | A | | 3/1999 | Kast et al. | |
| 5,924,130 | A | | 7/1999 | Fragomeli | |
| 6,029,277 | A | * | 2/2000 | Picchione, II | 2/162 |
| 6,418,561 | B1 | | 7/2002 | Gregory | |
| 6,430,744 | B1 | | 8/2002 | Redman et al. | |
| 6,449,772 | B1 | * | 9/2002 | Donner | 2/170 |

FOREIGN PATENT DOCUMENTS

| | | |
|---|---|---|
| FR | 1074476 | 4/1953 |
| FR | 77975 | 4/1962 |
| GB | 287546 | 5/1928 |
| GB | 494421 | 10/1938 |
| GB | 1492944 | 11/1977 |
| GB | 1514611 | 6/1978 |
| WO | WO 93/00834 | 1/1993 |

* cited by examiner

ARTICLE OF THERMAL CLOTHING FOR COVERING THE UNDERLYING AREA AT THE GAP BETWEEN A COAT SLEEVE AND A GLOVE

REFERENCE TO COPENDING APPLICATION

This is a continuation-in-part of U.S. patent application Ser. No. 10/196,352, filed Jul. 16, 2002 in the name of Kathryn Gregory, by Susan B. Gregory, Legal Representative, (which patent application is hereby incorporated herein by reference), now abandoned, which is, in turn, a continuation of U.S. patent application Ser. No. 09/243,274, filed Feb. 2, 1999 in the name of Kathryn Gregory, by Susan B. Gregory, Legal Representative, for ARTICLE OF THERMAL CLOTHING FOR COVERING THE UNDERLYING AREA AT THE GAP BETWEEN A COAT SLEEVE AND A GLOVE, now U.S. Pat. No. 6,418,561, which is in turn a continuation-in-part of prior application Ser. No. 08/669,653, filed Jun. 24, 1996 by Kathryn Gregory, by Susan B. Gregory, Legal Representative, for ARTICLE OF THERMAL CLOTHING FOR COVERING THE UNDERLYING AREA AT THE GAP BETWEEN A COAT SLEEVE AND A GLOVE, now U.S. Pat. No. 5,864,886, which is in turn a continuation-in-part of prior application Ser. No. 08/318,142, filed Oct. 5, 1994 by Kathryn Gregory, by Susan B. Gregory, Legal Representative, for ARTICLE OF THERMAL CLOTHING FOR COVERING THE UNDERLYING AREA AT THE GAP BETWEEN A COAT SLEEVE AND A GLOVE, now abandoned.

FIELD OF THE INVENTION

The present invention relates to articles of clothing in general, and more particularly to articles of thermal clothing.

BACKGROUND OF THE INVENTION

During winter activities, snow can sometimes find its way into the gap between the end of a coat sleeve and a glove. This snow may thereafter migrate up the coat sleeve and/or down into the glove. The presence of this cold snow against the underlying skin can cause a person substantial discomfort and, in some cases, may actually lead to serious injury, e.g. frostbite.

Moreover, during some winter activities, exaggerated arm movements may sometimes occur. These exaggerated arm movements can widen the gap between the end of the coat sleeve and the glove, thereby exposing the underlying skin directly to the cold. Again, this can cause a person significant discomfort, and may possibly even lead to serious injury.

A number of attempts have been made to cover the underlying area at the gap between the end of a coat sleeve and a glove.

For example, mittens have been lengthened so that they can extend back over the coat sleeve, up to the forearm area. This helps prevent snow and/or cold air from finding its way down to the underlying skin. Unfortunately, these elongated mittens tend to be relatively large and cumbersome and may catch against nearby objects, e.g. a piece of machinery.

Another approach has been to use a special mitten liner. This special mitten liner consists of an ordinary knee-high cotton sock which has had a hole formed in the side of the sock, near its closed toe. This liner is worn over the hand and under the mitten, with the person's thumb extending out the side hole of the sock and the remaining four fingers being received in and covered by the toe of the sock. Unfortunately, since this mitten liner restricts four of the fingers to a single pocket, it cannot be used with a fingered glove. Furthermore, even when the mitten liner is used with a mitten, the presence of an additional layer of material between four of the fingers and the mitten tends to seriously diminish the wearer's ability to grasp and manipulate objects.

Also known are anatomically contoured physical therapy devices such as the one taught in U.S. Pat. No. 4,961,418, issued Oct. 9, 1990, to Mark McLaurin-Smith. Such therapeutic devices are often designed to fit over the wrist area of a patient. Unfortunately, these known devices provide significant therapeutic compression and support to the wearer's injured wrist area and, in the case of the McLaurin-Smith device, also provide significant skin surface stimulation to the wearer. Thus, such physical therapy garments are generally unsuitable for winter activities that are undertaken by uninjured persons.

OBJECTS OF THE INVENTION

Accordingly, one object of the present invention is to provide a novel article of thermal clothing for covering the underlying area at the gap between the end of a coat sleeve and a glove.

Another object of the present invention is to provide a novel article of thermal clothing for bridging the gap between the end of a coat sleeve and a glove.

Still another object of the present invention is to provide a novel article of thermal clothing which, when worn, does not cover the fingers so as to prevent their reception within the corresponding digits of a fingered glove.

Yet another object of the present invention is to provide a novel article of thermal clothing which, when worn, does not cover the fingers so as to diminish the wearer's ability to grasp and manipulate objects.

And another object of the present invention is to provide a novel article of thermal clothing which can be comfortably and conveniently worn under a coat sleeve and a glove so as to protect the area therebetween.

And still another object of the present invention is to provide a method for covering the underlying area at the gap between the end of a coat sleeve and a glove.

A still further object of the invention is to provide an article of clothing for covering the gap between the end of a coat sleeve and a glove, the article being provided with a pocket for receiving and retaining a warming device.

SUMMARY OF THE INVENTION

These and other objects of the present invention are achieved by providing a novel article of thermal clothing which generally comprises a tube having a distal portion terminating in a distal end, a proximal portion terminating in a proximal end, and a side opening formed in the distal portion adjacent to but spaced from the distal end. The tube is formed out of a flexible, somewhat stretchable material capable of providing good thermal insulation. Preferably this material is also water resistant.

In one preferred embodiment, the tube is formed out of a fabric which retains a memory of the shape of a wearer's hand and forearm so that, after repeated wearings by the user, the tube tends to be form fitting to that user.

The tube is sized so that it can be snugly fit over the wearer's hand and forearm, with the distal end of the tube being positioned near the midpalm area and the proximal end of the tube being positioned at the forearm area, and with the wearer's thumb extending out through the tube's side opening. When the tube is in this position, the wearer's thumb and fingers will remain completely free and unrestrained. The article of clothing is worn under a glove and the sleeve of a coat so as to bridge the gap therebetween and thereby prevent exposure of the underlying skin to snow and cold air. The article is provided with a pocket for receiving and retaining a warming device. This article of clothing could also be worn alone.

BRIEF DESCRIPTION OF THE DRAWINGS

These and other objects and features of the present invention will be more fully disclosed or rendered obvious by the following detailed description of the preferred embodiment of the invention, which is to be considered together with the accompanying drawings wherein like numbers refer to like parts and further wherein.

DETAILED DESCRIPTION OF THE PREFERRED EMBODIMENT

Figure 1:
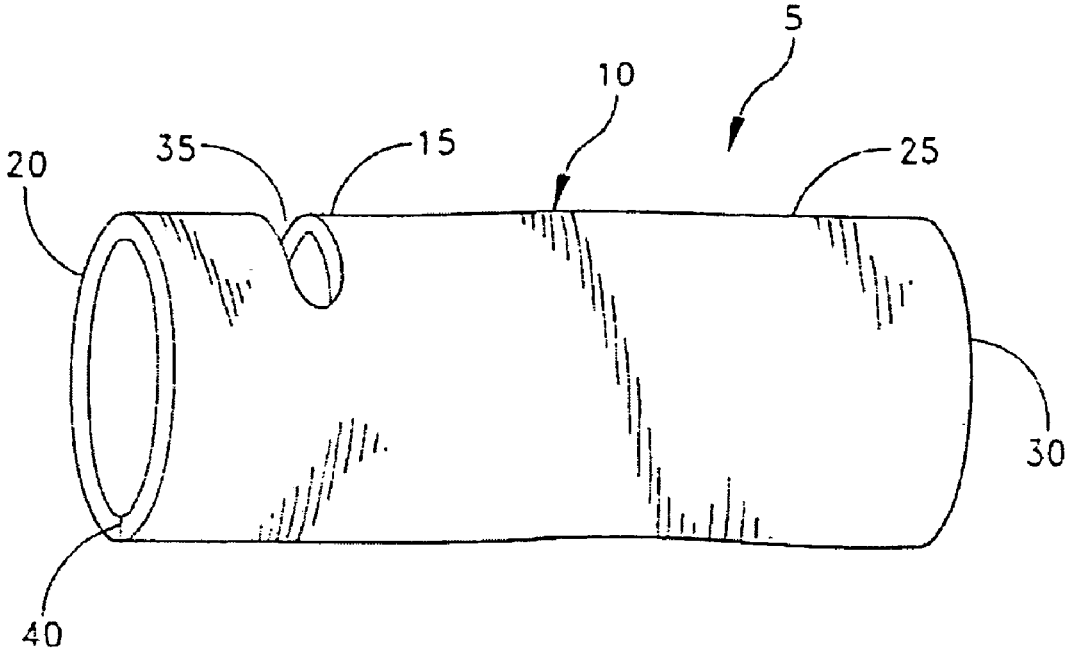
FIG. 1 is a perspective view showing the left side of an article of thermal clothing formed in accordance with the present invention.
Figure 2:
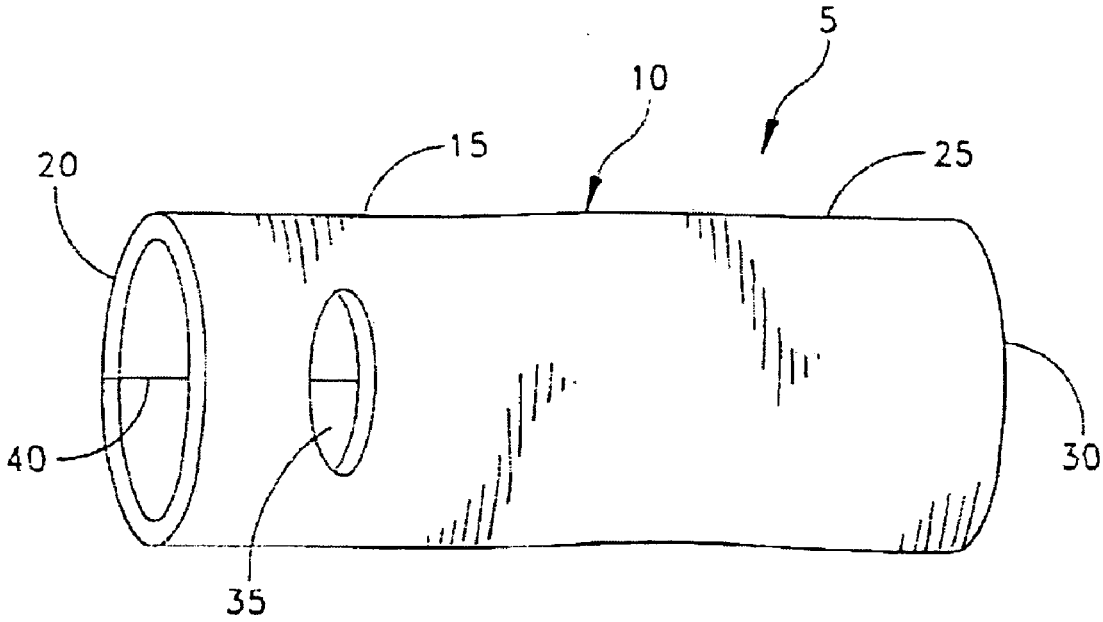
FIG. 2 is a perspective view showing the top side of the same article of thermal clothing.

Looking first at FIGS. 1 and 2, there is shown an article of thermal clothing 5 which generally comprises a tube 10.

Tube 10 comprises a distal portion 15 terminating in a distal end 20 and a proximal portion 25 terminating in a proximal end 30. A side opening 35 is formed in distal portion 15 adjacent to but spaced from distal end 20. Side opening 35 is oriented in a substantially transverse direction relative to the tube's longitudinal axis (see, e.g. FIGS. 1–4). Side opening 35 communicates with the interior of tube 10.

Figure 7:
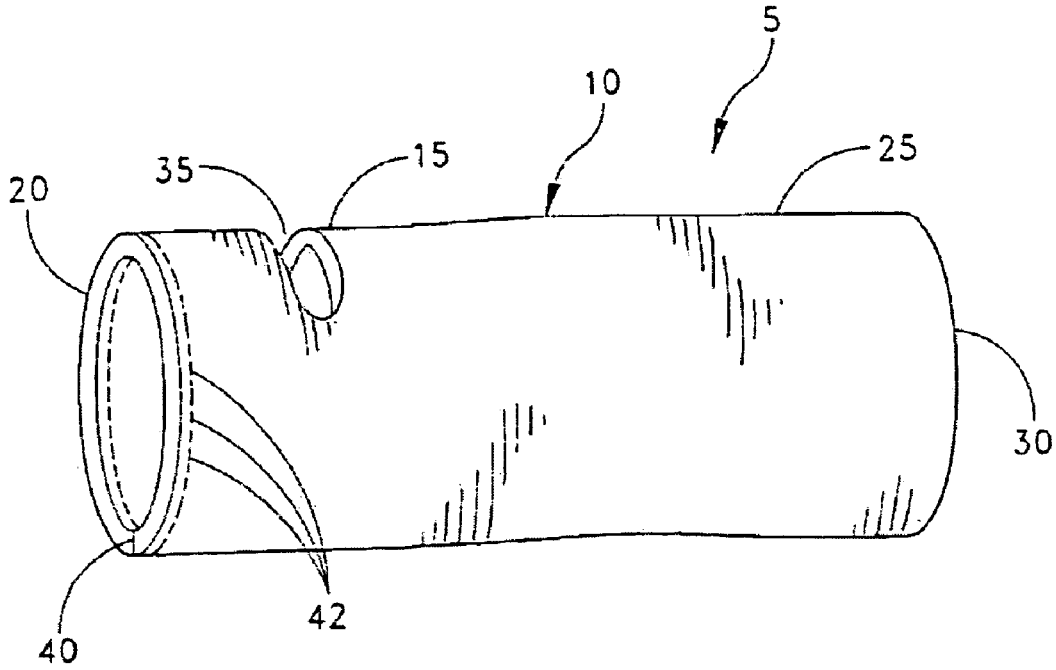
FIG. 7 is a perspective view of a tube formed in accordance with the present invention and showing stitching disposed on its distal end.

Tube 10 is formed out of a material which is flexible, somewhat stretchable, and which is capable of providing good thermal insulation. Preferably, tube 10 is also made out of a material which is water resistant. In practice, it has been found that tube 10 may be easily fabricated out of a woven, relatively resilient fabric sheet which is sewn together at a seam 40 so as to form the tube. It has also been found that, if desired, stitching 42 (FIG. 7) may be applied to distal end 20 so as to reduce stretching, as will hereinafter be disclosed in further detail.

In one preferred embodiment of the present invention, tube 10 is formed out of a knitted polyester fleece-type fabric such as the one manufactured by Malden Mills Industries, Inc. of Lawrence, Mass. under the trademarks POLARFLEECE™, POLARPLUS™, POLARLITE™, and POLARTEC™. Use of this knitted polyester fleece-type fabric in connection with the present invention has been found to be particularly advantageous. More particularly, the knitted polyester fleece-type fabric is a soft, lightweight insulator that resists moisture and dries very quickly, i.e., it breathes and wicks moisture very efficiently. Such knitted polyester fleece-type materials are hydrophobic, picking up less than about 1% of their weight in water, even when soaking wet. Since the fabric does not hold moisture, it tends to hold its loft and continue to retain its insulating properties even when coming into contact with moisture, e.g., from rain or melting snow or perspiration. Such knitted polyester fleece-type materials also tend to dry very quickly as a result of these properties.

Figure 8:
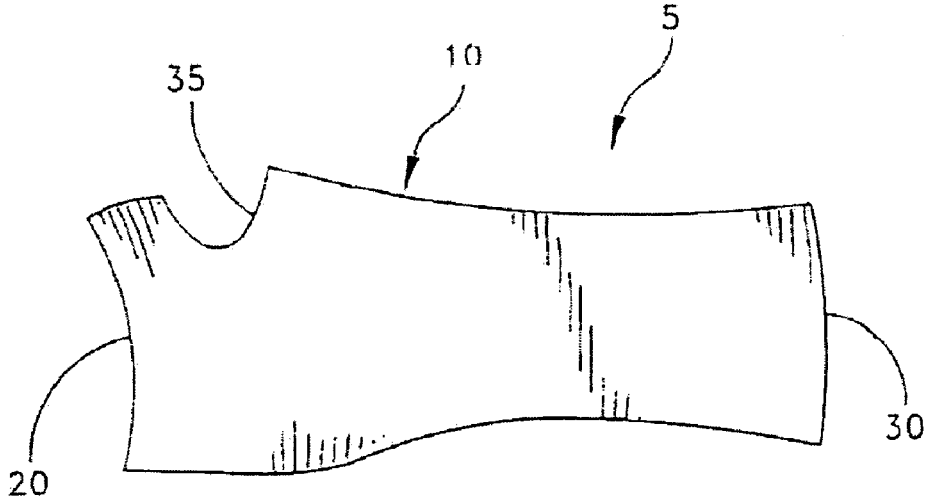
FIG. 8 is a side view of a tube formed in accordance with the present invention showing the form fitting properties of the tube after several uses.

In addition to the foregoing, the knitted polyester fleece-type fabric is also inherently form-fitting, i.e., the tube 10 formed out of such a material will substantially assume the shape of a wearer's arm after several wearings (see FIG. 8).

It has also been recognized that a knitted polyester fleece-type fabric will resist unraveling at a cut edge, and thereby inhibit any fraying of distal end 20, proximal end 30 and side opening 35 when tube 10 is snugly fit over a wearer's hand and forearm, as will hereinafter be disclosed in further detail. The resistance to unraveling exhibited by such a knitted polyester fleece-type fabric is due to the extremely tight, circular knit construction of these fabrics. The inherent resistance to unraveling exhibited by knitted polyester fleece-type fabrics allows for a significant reduction in manufacturing steps since hemming, stitching or the like are not required to hold the cut edges of the fabric together.

Figure 3:
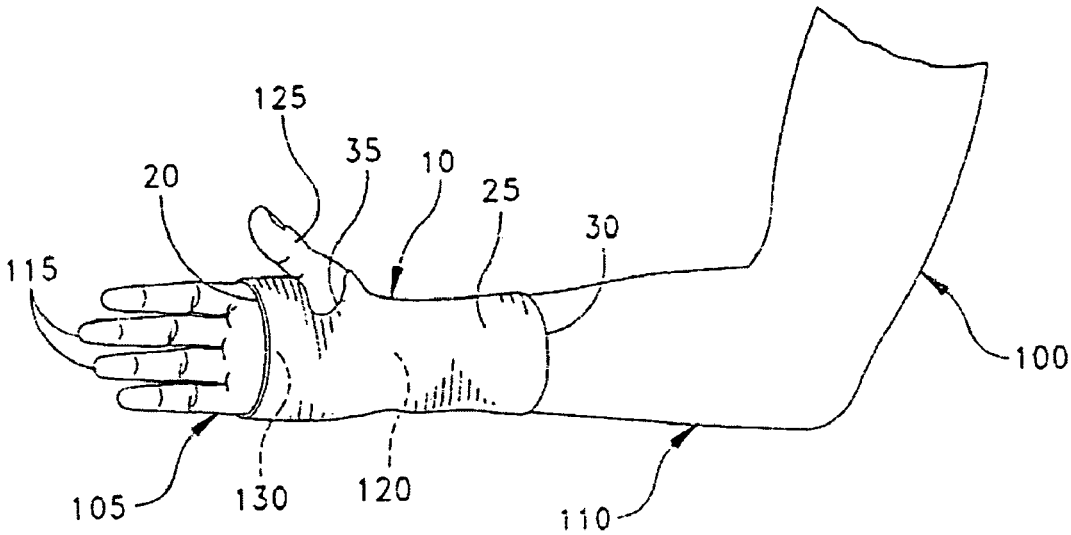
FIG. 3 is a left side view showing the article of thermal clothing fitted about the hand and forearm of a person.
Figure 4:
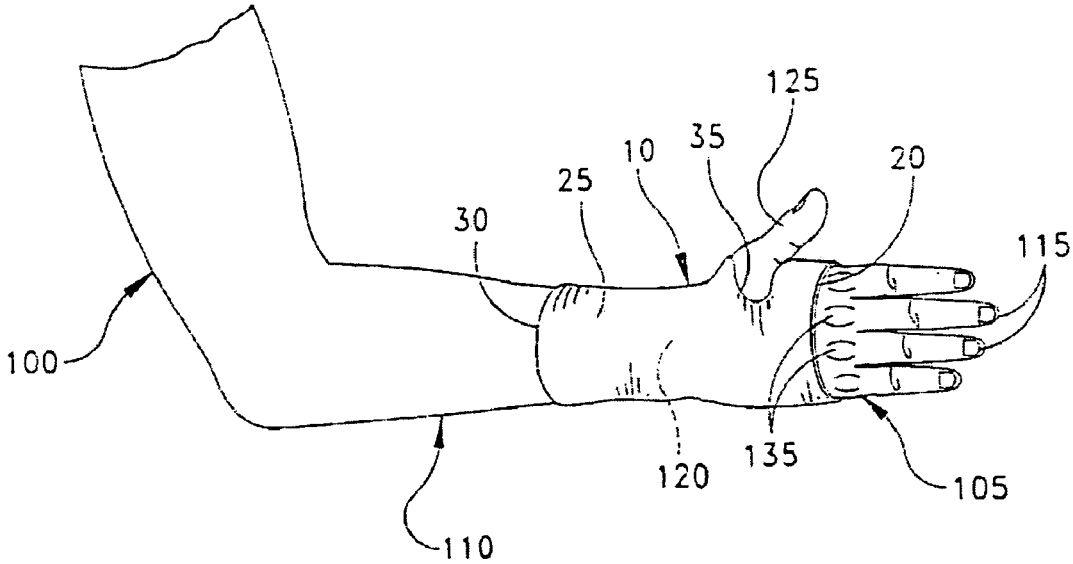
FIG. 4 is a right side view showing the article of thermal clothing fitted about the hand and forearm of a person.

Looking next at FIGS. 3 and 4, tube 10 is intended to be worn on a human arm 100 so as to partially cover a hand 105 and a forearm 110. More particularly, fingers 115 are first inserted into the open proximal end 30 of tube 10. Then the tube's proximal portion 25 is pulled over fingers 115, past wrist 120 and up onto forearm 110. As this occurs, fingers 115 exit the distal end 20 of tube 10, and thumb 125 protrudes out side opening 35.

Tube 10 is sized so that it can make a snug fit about the hand and forearm of the wearer when it is in the position shown in FIGS. 3 and 4. More particularly, tube 10 is sized so that when it is properly in position, the tube's distal end 20 will extend snugly around the hand's midpalm area 130 between a first set of knuckles 135 (FIG. 4) and thumb 125. By allowing the first set of knuckles 135 to reside distally of the tube's distal end 20, fingers 115 on hand 105 will remain free and unrestrained. At the same time, side opening 35 is sized so that it will make a close fit around thumb 125. This will help prevent the tube's distal portion 15 from sliding off the midpalm area 130 of hand 105. The tube's proximal portion 25 is sized so as to make a snug fit around forearm 110 and thereby prevent tube 10 from sliding off forearm 110.

In order to provide a snug yet comfortable fit, it is preferred that the tube 10 be undersized slightly with respect to the wearer's anatomy. This will force the somewhat stretchable material of the tube to yield slightly when being fit onto hand 105 and forearm 110, thereby providing the desired snug yet comfortable fit. In this respect it will be appreciated that, inasmuch as the knitted polyester fleece-type fabric is inherently form-fitting, the tube 10 will substantially assume the shape of a wearer's arm after several wearings (FIG. 8).

In view of the foregoing construction, when tube 10 is properly positioned on arm 100, the tube will tend to remain snugly and securely in place, covering the arm between the midpalm area 130 and forearm 110.

It has been found that the application of stitching 42 to distal end 20 is can be advantageous. More particularly, such stitching 42 acts to reduce stretching of distal end 20 in midpalm area 130 during use. This arrangement has been found to be superior to other ways of restricting stretching of distal end 20, e.g., by applying elastic means to distal end 20 so as to reduce stretching.

It will be appreciated that with a knitted polyester fleece-type fabric, the edges of tube 10 that define side opening 35 will resist unraveling and thereby further ensure a close fit around thumb 125. This resistance to unraveling is an inherent characteristic of a knitted polyester fleece-type fabric and has been found to be far superior to other techniques for preventing unraveling or unstitching, e.g., hemming or other stitching about the edges of side opening 35.

With respect to side opening 35, the resistance to unraveling is further enhanced by orienting side opening 35 in a substantially transverse direction relative to the tube's longitudinal axis, since the extremely tight, circularly-knit fibers adjacent to both corners of side opening 35 will carry the load exerted by the wearer's thumb. It will also be appreciated that by orienting side opening 35 in a substantially transverse direction relative to the tube's longitudinal axis, side opening 35 will tend to remain in a close fit around the base of the wearer's thumb when an outer garment is pulled over tube 10.

Figure 5:
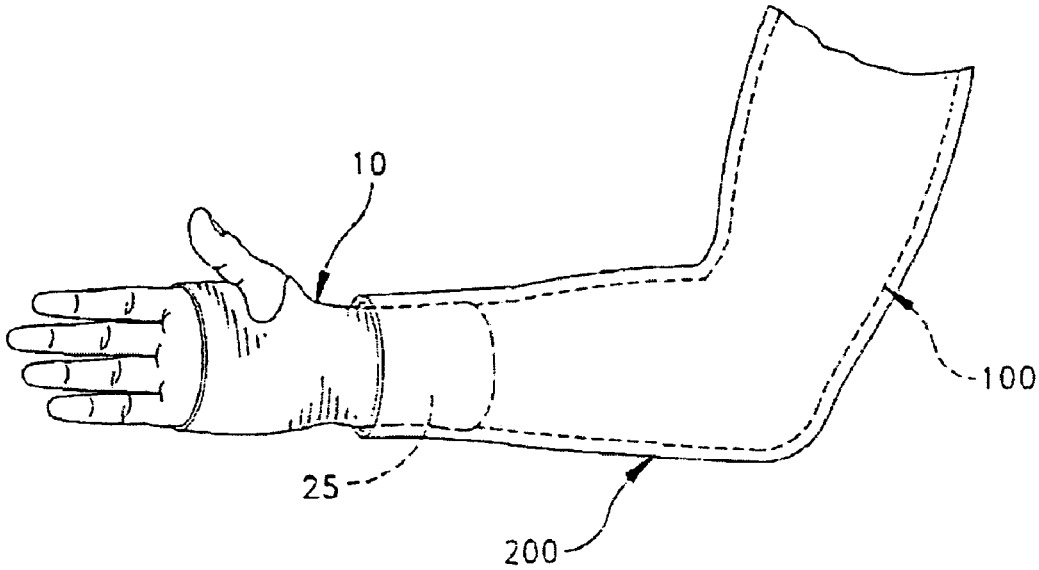
FIG. 5 is a left side view showing the article of thermal clothing being worn under a coat sleeve.

Looking next at FIG. 5, a coat sleeve 200 is easily pulled over arm 100 and tube 10 so as to substantially cover the proximal portion 25 of tube 10. Then a glove 300 (FIG. 6) is easily pulled over hand 105 and the distal portion of tube 10 so as to cover the hand. As this occurs, the proximal end 305 of glove 300 will approach the distal end 205 of coat sleeve 200, typically leaving a small gap 400 between coat sleeve 200 and glove 300. Tube 10 bridges this gap 400 so as to prevent snow and cold air from contacting the skin underlying gap 400. Furthermore, inasmuch as tube 10 extends from the hand's midpalm area 130 to forearm 110, the tube will be fully capable of protecting the underlying skin from migrating snow and cold air as gap 400 widens and closes during arm movements.

Figure 6:
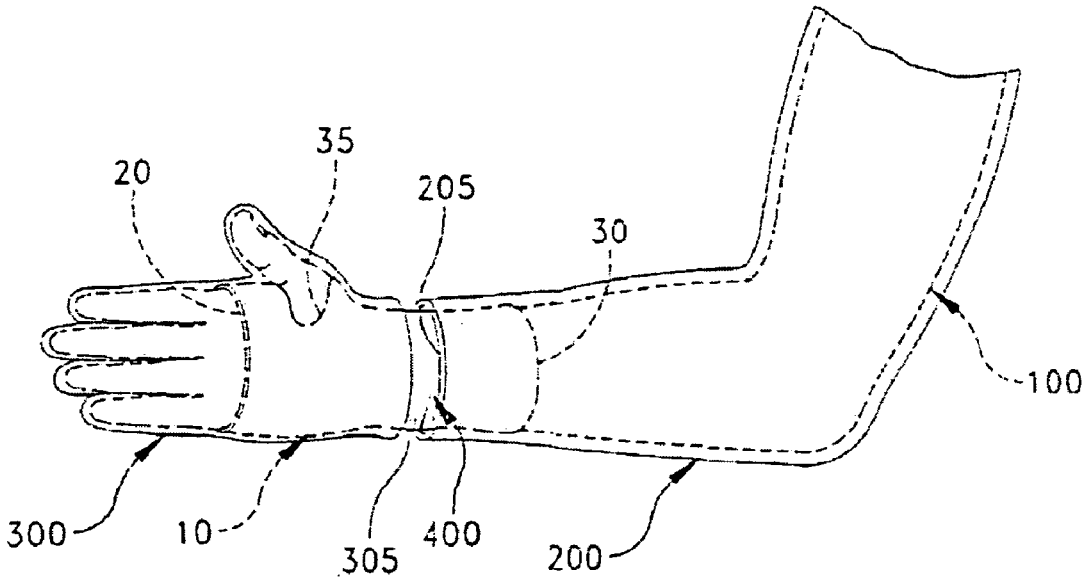
FIG. 6 is a left side view showing the article of thermal clothing being worn under a coat sleeve and under a glove.

It will also be appreciated that, inasmuch as tube 10 leaves fingers 115 free, tube 10 can be worn under a glove with no loss of manual dexterity. In addition, since tube 10 leaves fingers 115 completely free and separate, glove 300 can comprise either a mitten or a conventional fingered glove (as shown in FIG. 6).

Inasmuch as the article of thermal clothing 5 is arranged to integrally cover the wearer's skin from the midpalm area 130 to forearm 110, the wearer will receive significant thermal protection even when a glove or mitten is not being worn. Thus, workers and/or recreationists who must keep their fingers uncovered (i.e., by removing or leaving off a glove or mitten) will still receive significant thermal protection for the midpalm and wrist areas due to the use of the present invention. This includes indoor applications where warmth and comfort are greater factors (FIG. 3). Furthermore, it is anticipated that the present invention might also be used in conjunction with fingerless gloves to provide wrist protection for workers and/or recreationists who must keep their fingers uncovered in the cold air.

Side opening 35 may be positioned immediately adjacent to distal end 20. In some cases, however, it is preferable to position side opening 35 further toward proximal portion 25. This arrangement allows for greater coverage of the hand thus providing for greater hand warmth while still allowing free and unrestrained hand movement. Such an arrangement is particularly advantageous in situations where article 5 is to be worn without a glove.

MODIFICATIONS

It will be appreciated that various changes, modifications and alterations may be made to the preferred embodiments disclosed above without departing from the spirit or scope of the present invention.

Figure 9:
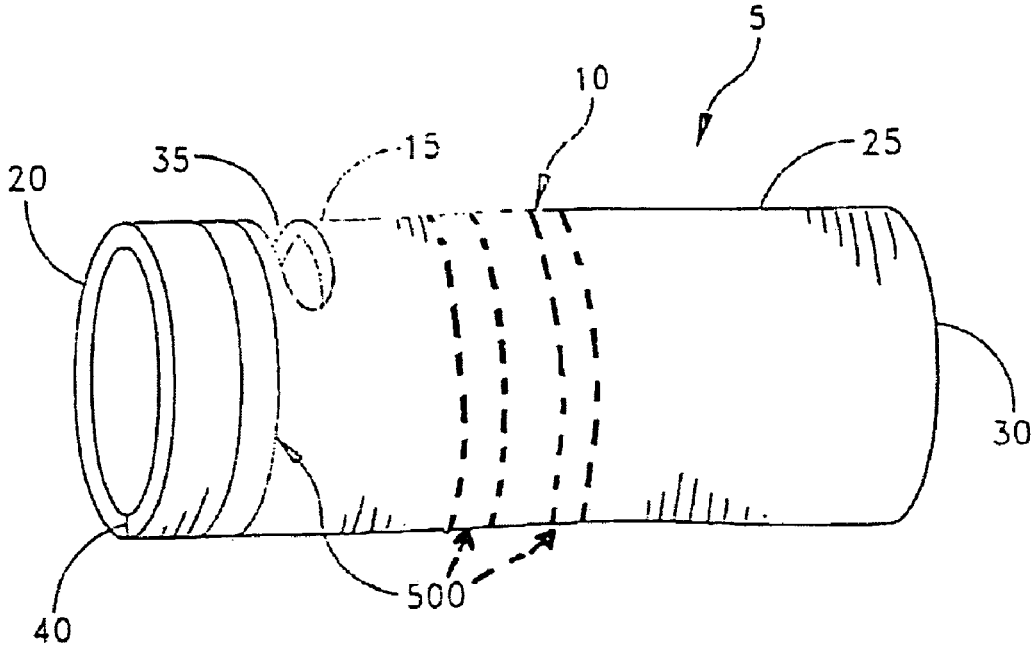
FIG. 9 is a perspective view, similar to that shown in FIG. 1, showing a reflective stripe disposed on the distal portion of the tube.

For example, in one such alternative embodiment of the invention, shown in FIG. 9, one or more reflective stripes 500 may be fastened to the outer surface of tube 10. Stripes 500 may be sewn to the outer surface of tube 10 or they may be adhesively fastened thereon by adhesive means well known in the art. Stripes 500 provide for increased visibility and greater safety in situations where article 5 is to be worn without a glove. Furthermore, stripes 500 might be located proximally of side opening 35 as indicated by dotted lines in FIG. 9. When stripes 500 are located in the latter position, they may be visible through the gap 400 between coat sleeve 200 and glove 300 (see FIG. 6), or when article 5 is to be worn without a glove. This can also increase visibility and hence safety.

Figure 10:
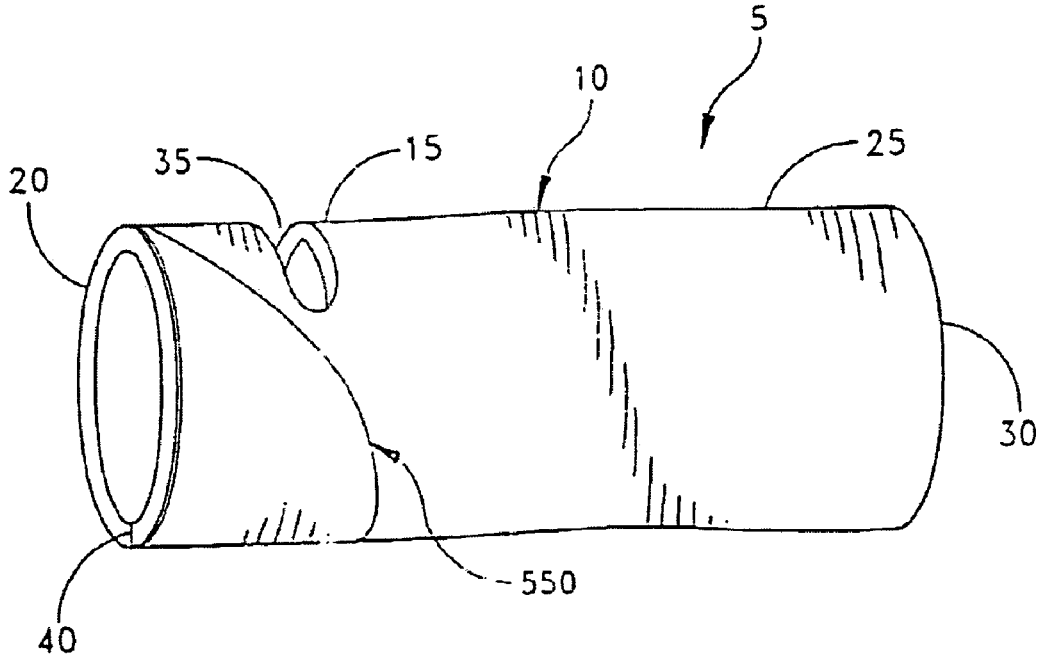
FIG. 10 is a perspective view, similar to that shown in FIG. 1, showing a leather patch disposed on the palm region of the distal portion of the tube.

Additionally, a leather patch 550 may be fastened to distal portion 15 of tube 10 to protect against wear (see, FIG. 10). Leather patch 550 can be particularly useful in situations where article 5 is to be worn without a glove.

Figure 11:
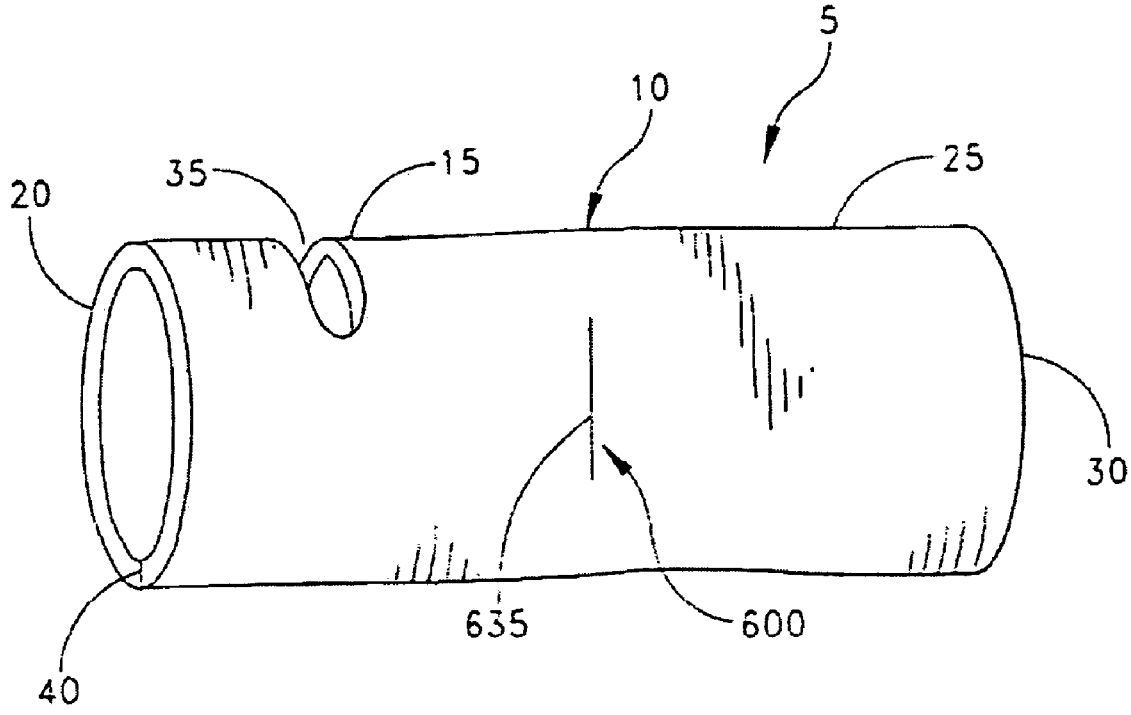
FIG. 11 is a perspective view, similar to that shown in FIG. 1, showing a watch port.

Also, as shown in FIG. 11, a watch port 600 may be disposed in tube 10. More particularly, a second side opening 635 is formed adjacent to distal portion 15. Side opening 635 also communicates with the interior of tube 10, and is positioned along tube 10 so as to be disposed over the face of a wristwatch. Watch port 600 allows the wearer to view her watch while wearing tube 10. It will be appreciated that a single watch port 600 may be disposed in only one side of tube 10, thus for a "left-handed" or "right-handed" tube 10. Alternatively, two watch ports may be added to tube 10, one to each side of the tube, so as to render tube 10 interchangeable between the wearer's left and right hands.

Figure 12:
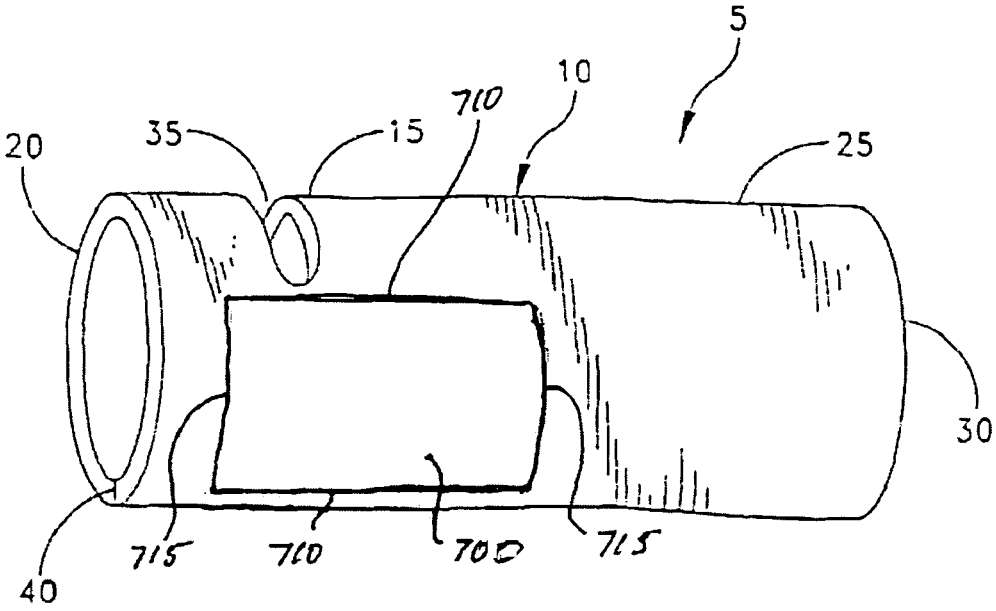
FIG. 12 is similar to FIG. 1 and further illustrating a pocket on the tube for receiving and retaining a warming device.

Referring to FIG. 12, it will be seen that a pocket 700 may be added to the article 5 near the distal end 20. The pocket 700 is adapted to hold a warming device 705 (FIG. 13), such as those commonly used to keep hands warm. Additionally, the pocket 700 may hold identification, credit cards, drivers license, money, and the like.

Figure 13:
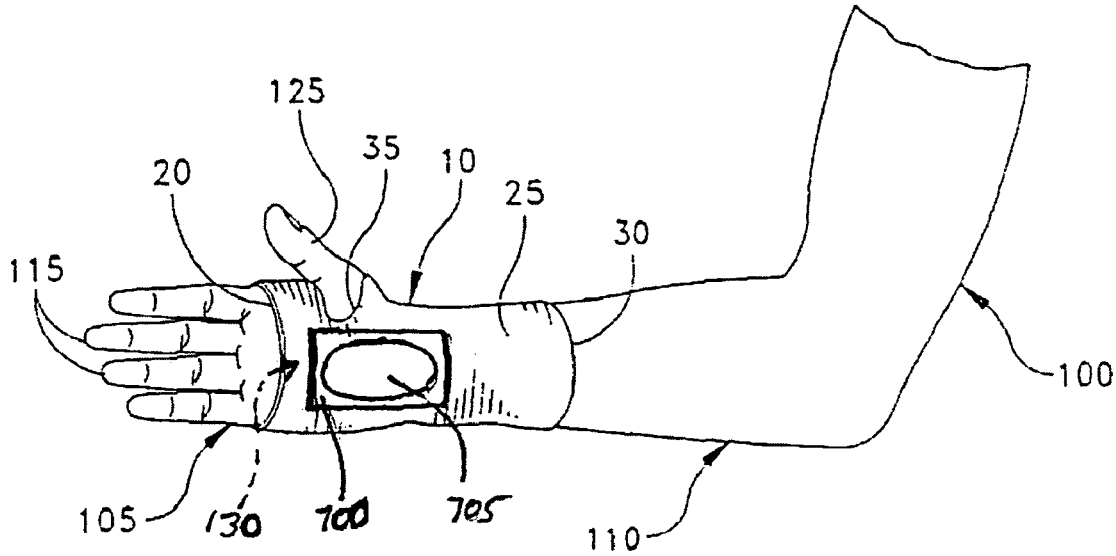
FIG. 13 is similar to FIG. 3, but further illustrates the pocket of FIG. 12.

As illustrated in FIG. 13, the pocket 700 preferably is of a rectangular configuration and extends from about the mid palm area 130 to proximally of the thumb 125, and is sized to accept and hold the aforementioned items, including the warming device 705. The pocket 700 is closed along side edges 710 thereof and open along a selected one of the end edges 715 thereof.

If desired, the knitted polyester fleece-type fabrics can also be chemically treated in ways well known in the art so as to further enhance their water resistant properties.

In addition, the knitted polyester fleece-type fabric may also comprise other material such as Lycra™, cotton, wool, nylon, rayon, etc. that may be added to the fabric so as to give the article 5 a desired characteristic, e.g., greater warmth, greater durability, etc.

It is to be understood that the present invention is by no means limited to the particular constructions herein disclosed and shown in the drawings, but also comprises any modifications or equivalents within the scope of the claims.

What is claimed is:

1. An article of thermal clothing for covering an underlying area at a gap between a coat sleeve and a glove, said article comprising:

a tube having a distal portion terminating in a distal end, a proximal portion terminating in a proximal end, and a side opening formed in the distal portion adjacent to but spaced from the distal end;

said tube being formed out of a fabric that is flexible and stretchable, wherein the fabric retains a memory of the shape of a wearer's hand and forearm so that after repeated uses by the wearer, said tube tends to be form fitting;

said tube being sized so that it can be snugly fit over the wearer's hand and forearm so that the distal end of said tube is positioned near a midpalm area of the hand and the proximal end of said tube is positioned at a forearm area, with the wearer's thumb extending out through the tube's side opening; and a pocket fixed to said tube, wherein the pocket is open at a selected end thereof and adapted to receive a selected article therein;

wherein the pocket is sized to accept and hold a warming device, a credit card, an identification card, or a driver's license;

wherein the pocket is positioned on said tube so that when the user is wearing the tube, the pocket extends from the mid-palm area of the user to proximally of the thumb of the user;

and further wherein the pocket terminates sufficiently far from the proximal end of the tube so that when the user is wearing the tube, and the article is held in the pocket, the user will retain substantially complete flexibility of the wrist.

2. An article of thermal clothing according to claim 1 wherein the fabric comprises a fleece-type knitted polyester.

3. An article of thermal clothing according to claim 2 wherein the fleece-type knitted polyester comprises a circular construction so as to form an extremely tight knit fabric.

4. An article of thermal clothing according to claim 3 wherein the fabric further comprises added fibers chosen from a group consisting of spandex, cotton, wool, nylon, rayon, and blends thereof.

5. An article of thermal clothing according to claim 4 wherein the fleece-type fabric is capable of providing good thermal insulation without providing skin stimulation therapy to skin coming into contact with said tube, and said tube is sized so that it can be snugly fit over the wearer's hand and forearm without providing therapeutic compression thereto.

6. An article of thermal clothing according to claim 1 wherein the side opening is formed substantially transverse to a longitudinal axis of said tube.

7. An article of thermal clothing according to claim 6 wherein the side opening is: (i) sized to form a close fit with the base of the wearer's thumb so as to restrict movement of said tube relative to the hand of the wearer, and (ii) resistant to unraveling so as to inhibit enlargement of the opening when said tube is snugly fit over the wearer's hand and forearm.

8. An article of thermal clothing according to claim 1 wherein the fabric is capable of providing uninhibited movement of the wearer's hand relative to the wearer's forearm.

9. An article of thermal clothing according to claim 1 wherein said tube further includes reflective means for increasing the visibility of the wearer, said reflective means being positioned on at least the portion of said tube disposed in the gap between the coat sleeve and the glove.

10. An article of thermal clothing according to claim 1 wherein the side opening is formed in the distal portion of said tube and spaced proximally from the distal end so as to position the distal portion of said tube substantially over the entire palm of the hand when the thumb is disposed within the side opening.

11. An article of thermal clothing according to claim 1 wherein the distal end of said tube is stitched so as to maintain said tube in snug engagement with the midpalm area of the wearer's hand.

12. An article of thermal clothing according to claim 1 wherein said tube further includes a relatively durable material fastened to a portion of the tube's distal portion and disposed on the midpalm area.

13. An article of thermal clothing according to claim 12 wherein the relatively durable material comprises leather.

14. An article of thermal clothing according to claim 1 wherein said tube comprises a second side opening disposed proximally of the side opening forming a close fit with said base of said wearer's thumb, said second side opening being sized and positioned along said tube so as to provide access to a watch disposed on the forearm.

15. An article of thermal clothing according to claim 14 wherein said tube comprises a third side opening disposed in opposing relation to said second side opening, thereby adapting said tube to be worn on either the wearer's left or right arm.

16. The article of clothing in accordance with claim 1 wherein said pocket is open at a proximal end thereof.

17. An article of thermal clothing for covering an underlying area at a gap between a coat sleeve and a glove, said article comprising:

a tube having a distal portion terminating in a distal end, a proximal portion terminating in a proximal end, and a side opening formed in the distal portion adjacent to but spaced from the distal end;

said tube being formed out of a fabric that is flexible and stretchable, wherein the fabric retains a memory of the shape of a wearer's hand and forearm so that after repeated uses by the wearer, said tube tends to be form fitting;

said tube being sized so that it can be snugly fit over the wearer's hand and forearm so that the distal end of said tube is positioned near a midpalm area of the hand and the proximal end of said tube is positioned at the forearm area, with the wearer's thumb extending out through the tube's side opening; and a pocket fixed to said tube, wherein the pocket is open at a selected end thereof and adapted to receive a selected article therein;

wherein the pocket is sized to accept and hold a warming device, a credit card, an identification card, or a driver's license;

wherein the pocket is positioned on said tube so that when the user is wearing the tube, the pocket extends from the mid-palm area of the user to proximally of the thumb of the user;

and further wherein the pocket terminates sufficiently far from the proximal end of the tube so that when the user is wearing the tube, and the article is held in the pocket, the user will retain substantially complete flexibility of the wrist;

said tube including reflective means for increasing the visibility thereof, said reflective means being positioned on said tube between the proximal end and the side opening adjacent to the wearer's wrist.

18. An article of thermal clothing for covering an underlying area at a gap between a coat sleeve and a glove, said article comprising:

a tube having a distal portion terminating in a distal end, a proximal portion terminating in a proximal end, and a side opening formed in the distal portion adjacent to but spaced from the distal end;

said tube being formed out of a fabric that is flexible and stretchable, wherein the fabric retains a memory of the shape of a wearer's hand and forearm so that after repeated uses by the wearer, said tube tends to be form fitting;

said tube being sized so that it can be snugly fit over the wearer's hand and forearm so that the distal end of said tube is positioned near a midpalm area of the hand and the proximal end of said tube is positioned at a forearm area, with the wearer's thumb extending out through the tube's side opening; and a pocket fixed to said tube and open at a selected end and adapted to receive a selected article;

wherein said tube comprises a second side opening disposed proximally of the side opening forming a close fit with said base of said wearer's thumb, said second side opening being sized and positioned along said tube so as to provide access to a watch disposed on the forearm.

19. An article of thermal clothing for covering an underlying area at a gap between a coat sleeve and a glove, said article comprising:

a tube having a distal portion terminating in a distal end, a proximal portion terminating in a proximal end, and a side opening formed in the distal portion adjacent to but spaced from the distal end;

said tube being formed out of a fabric that is flexible and stretchable, wherein the fabric retains a memory of the shape of a wearer's hand and forearm so that after repeated uses by the wearer, said tube tends to be form fitting;

said tube being sized so that it can be snugly fit over the wearer's hand and forearm so that the distal end of said tube is positioned near a midpalm area of the hand and the proximal end of said tube is positioned at a forearm area, with the wearer's thumb extending out through the tube's side opening; and a pocket fixed to said tube and open at a selected end and adapted to receive a selected article;

wherein said tube comprises a third side opening disposed in opposing relation to a second side opening, thereby adapting said tube to be worn on either the wearer's left or right arm.

* * * * *